United States Patent [19]

Taplin

[11] Patent Number: 4,695,230

[45] Date of Patent: Sep. 22, 1987

[54] POWER TRANSMISSION

[75] Inventor: Lael B. Taplin, Union Lake, Mich.

[73] Assignee: Vickers, Incorporated, Troy, Mich.

[21] Appl. No.: 943,823

[22] Filed: Dec. 29, 1986

Related U.S. Application Data

[63] Continuation of Ser. No. 808,527, Dec. 13, 1985, abandoned.

[51] Int. Cl.[4] ..... F04B 1/26

[52] U.S. Cl. ..... 417/218; 417/222; 60/452

[58] Field of Search ..... 417/218, 222, 220, 212, 417/213, 219, 221; 60/452, 450

[56] References Cited

U.S. PATENT DOCUMENTS

| | | | |
|---|---|---|---|
| 2,502,546 | 4/1950 | Adams | 417/222 X |
| 3,067,693 | 12/1962 | Lambeck | 417/219 |
| 3,809,500 | 5/1974 | Staudenrausch | 417/222 |
| 3,949,649 | 4/1976 | Bosch | 417/218 X |
| 3,987,624 | 10/1976 | Cooke et al. | 60/450 X |
| 4,325,215 | 4/1982 | Yamamoto | 60/450 |

*Primary Examiner*—Carlton R. Croyle
*Assistant Examiner*—Paul F. Neils
*Attorney, Agent, or Firm*—Barnes, Kisselle, Raisch, Choate, Whittemore & Hulbert

[57] ABSTRACT

A variable displacement pump system including a pressure compensator for operating a pump adjusting mechanism to vary the displacement by applying hydraulic fluid to the pump adjusting mechanism and a spring biased piston applying a yielding force to the pump adjusting mechanism opposing the pressure compensator. A load sensing valve senses the pressure of the load to which fluid is supplied from the pump through a system valve and applies this load pressure to work in unison with the spring biased piston for purposes of urging the pump towards its maximum displacement.

2 Claims, 2 Drawing Figures

POWER TRANSMISSION

This application is a continuation of application Ser. No. 808,527, filed Dec. 13, 1985, now abandoned.

This invention relates to variable displacement pump systems.

BACKGROUND AND SUMMARY OF THE INVENTION

It is known to provide a variable displacement pump with a pressure compensator for operating a pump adjusting mechanism to vary the displacement of the pump and a spring biased piston which yieldingly opposes the pressure compensator. It is aso known to provide a load sensing valve which functions to vary the displacement of the pump and a same spring biased piston which yieldingly opposes the load sensing compensator valve. The load sensing compensator is active as the primary pump control except when the pressure of the pump is at the limit set by the pressure compensator at which time the pressure compensator overrides the load sensing compensator. In addition, it is known to apply the fluid pressure delivered to a system or directional valve to work in unison with the spring biased piston.

One of the problems with such a system is that under heavy load and when the connecting lines are short, the system tends to become unstable causing hydraulic pulsations and resultant oscillating movement of the load or device being controlled.

Accordingly, an objective of the present invention is to provide a variable displacement pump system which is more stable.

In accordance with the invention, the load pressure as taken from a load sensing port or the system valve is connected to deliver this load pressure to the spring biased piston rather than using the output pressure of the pump to the spring biasing piston.

DESCRIPTION

Figure 1:
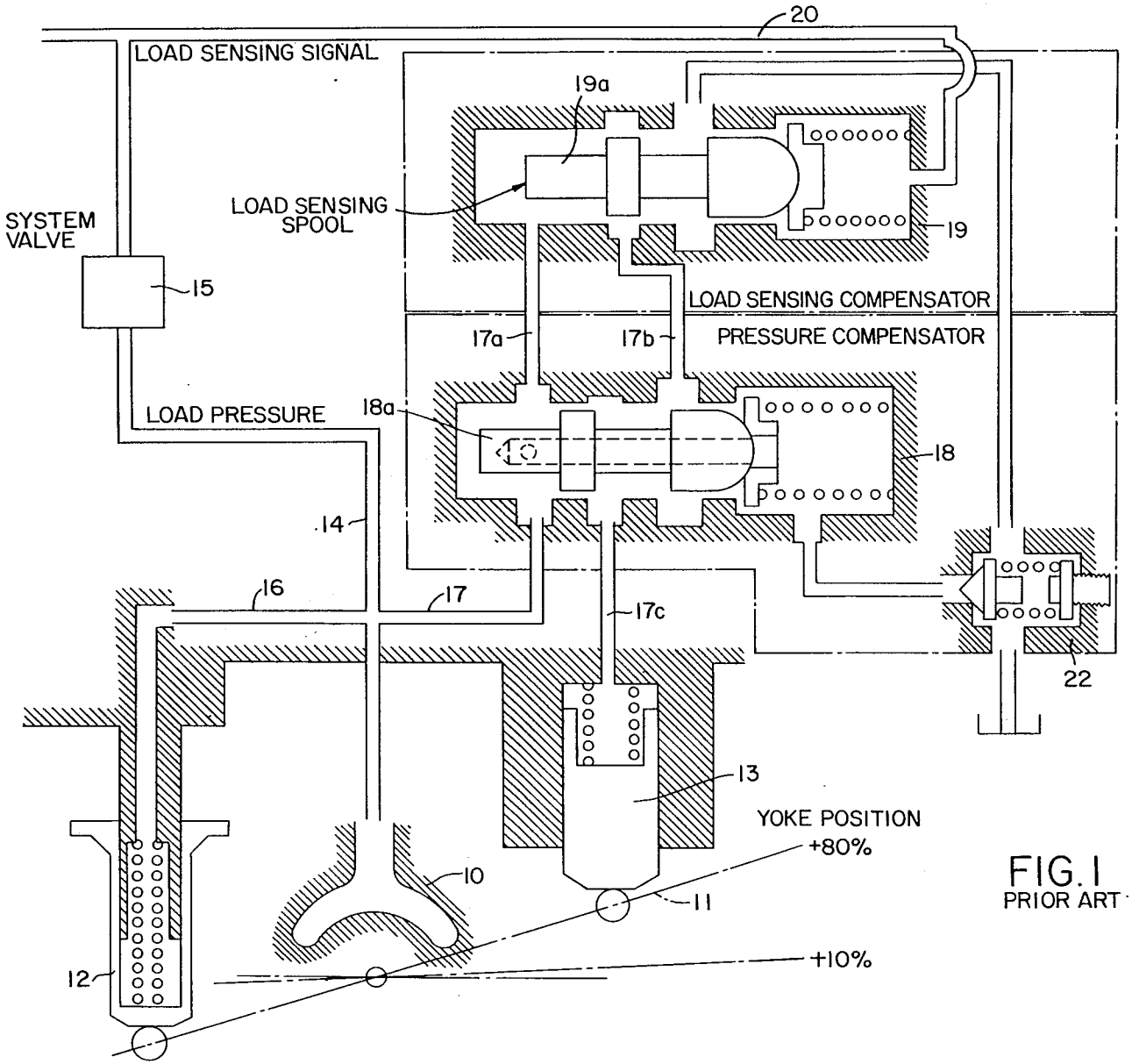
FIG. 1 PRIOR ART
FIG. 1 is a schematic of a prior art system.

It is believed that the variable displacement pump control system embodying the invention may best be understood by reference to FIG. 1 which is a hydraulic schematic of a prior art system such as that shown in U.S. Pat. No. 3,554,093, which is incorporated herein by reference.

As shown in FIG. 1, the variable displacement pump 10 may be of the variable swash plate type shown in the aforesaid patent and comprises a swash plate 11 that is movable to vary the displacement of axial pistons. A spring biased piston 12 yieldingly urges the swash plate 11 to a maximum displacement position. A larger yoke positioning piston 13 acts on the swash plate 11 in opposition to the spring biased piston 12.

Fluid from the pump 10 is directed to a load such as a hydraulic actuator through a line 14 to a system or directional valve 15, through a line 16 to the spring biased piston 12, and through a line 17 to a pressure compensator 18 includng a spool 18*a*. The pressure compensator 18 functions via the pilot valve 22 in a manner well known in the art to vary the displacement as the pressure increase above a limit set by the spring force on pilot valve 22. A load sensing compensator 19 is connected at one end by a line 20 downstream of the system valve to the pressure of fluid being delivered to the load by the system valve 15. The pump pressure via line 17—17*a* connects pump pressure to the opposite end of the load sensing spool 19*a*. The load sensing compensator 19 is connected through lines 17*b*, 17*c* so that it functions to control the pressure applied to the positioning piston 13. If the pressure of the pump is below the limit set by pilot 22, then the load sensing spool 19*a* of the load sensing compensator 19 controls the pump through the lines 17*c*, 17*b* to the positioning piston 13 to vary the displacement in a manner to deliver exactly the load flow required at a pump pressure above the load pressure, for example, 200 to 300 psi above the above load pressure. This 200 to 300 psi difference is achieved by the spring preload in the load compensator 19.

It has been found that such a system is unstable under high loads resulting in pulsating of the fluid and oscillating of the device being controlled, particularly when flows are small.

Figure 2:
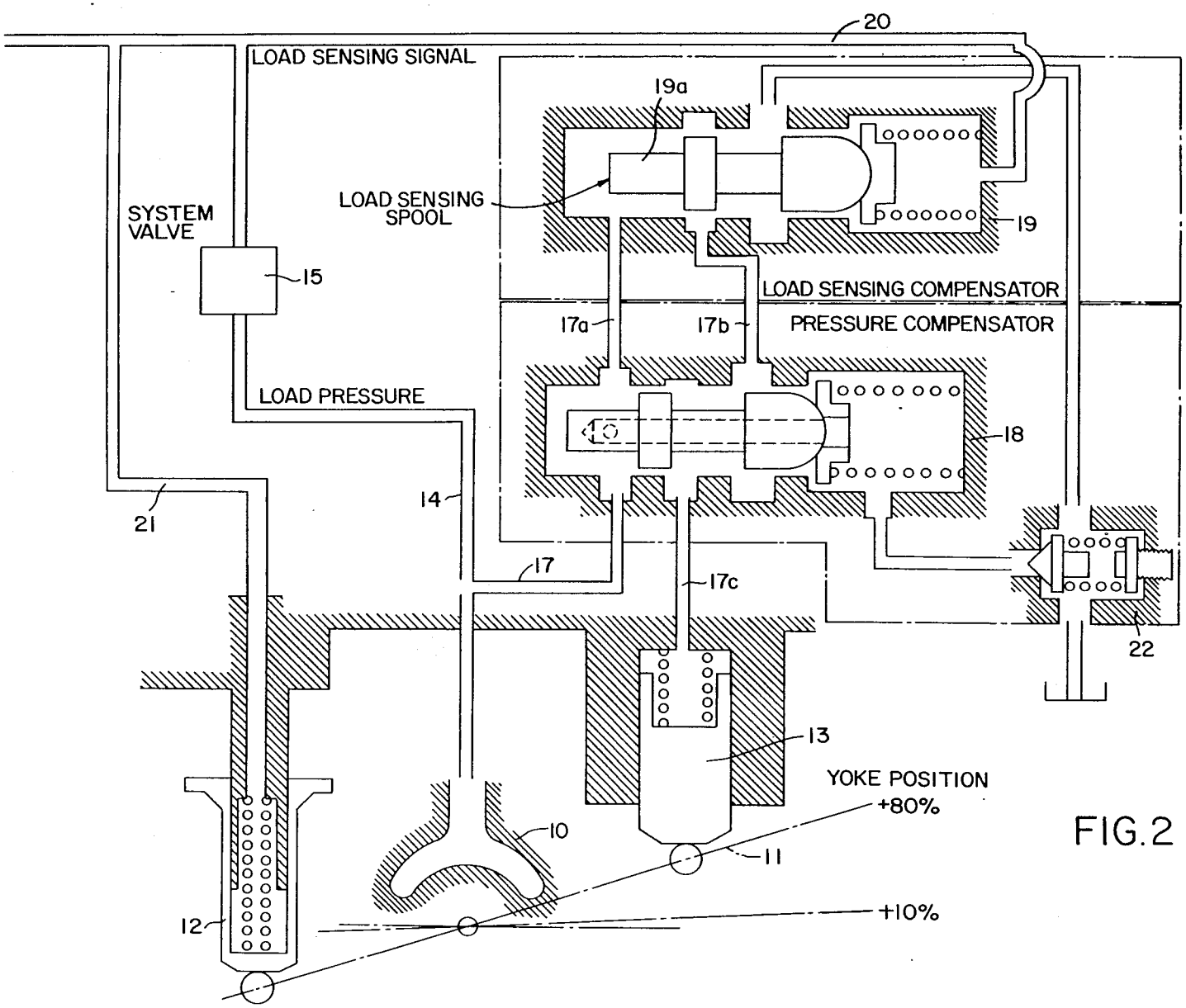
FIG. 2 is a schematic of a system embodying the invention.

Referring to FIG. 2, in accordance with the invention, the line 16 is eliminated and a line 21 extends from line 20 downstream of system valve 14 to the spring biased piston 12 to deliver load pressure to the biasing piston 12.

It has been found that such a system overcomes the problem of stability of the prior art system of FIG. 1.

Although the system has been described as used in connection with a variable displacement pump of the swash plate type, it will be understood by persons skilled in the art it is also applicable to other types of pumps having differing pump adjusting mechanisms for varying the displacement such as eccentric adjustable variable vane pumps and pumps using a rotating group housed in a tiltable yoke assembly.

I claim:

1. A variable displacement hydraulic pump control system comprising a variable displacement pump including a pump adjusting mechanism comprising a hydraulic positioning piston means and spring biased piston means yieldingly opposing said positioning piston means, load sensing spool compensator means, said pump having an oultet and an inlet, first passage means connecting the outlet of the pump to one end of said load sensing spool compensator means for sensing the pressure at the outlet of the pump which is being delivered to a load, second passage means extending between said load sensing spool compensator means and said positioning piston means for moving said pump adjusting mechanism in response to activation of said load sensing spool compensator means, a system valve, third passage means between the outlet of said pump and said system valve, fourth passage means extending between the other end of said load sensing spool compensator means and said system valve, and fifth passage means between said fourth passage means downstream of said system valve and said spring biased piston means.

2. The variable displacement pump control system set forth in claim 1 including pressure compensated spool means having one end connected to said first passage means, said pressure compensated spool means being connected in said second passage means and responsive to pressure in said second passage means to change the pressure to said positioning piston means and thereby vary the displacement of the pump adjusting mechanism when the pressure exceeds a predetermined amount.

* * * * *